109-49.5 SR
11/20/79 XR 4,174,711

United States Patent [19]
Laing et al.

[11] 4,174,711
[45] Nov. 20, 1979

[54] FIRE RESISTANT ENCLOSURE

[76] Inventors: Oliver Laing; Nikolaus Laing; Ingeborg Laing, all of Hofener Weg 35-37, D 7148 Remseck 2, Fed. Rep. of Germany

[21] Appl. No.: 843,157

[22] Filed: Oct. 17, 1977

[30] Foreign Application Priority Data

Oct. 19, 1976 [AT] Austria ..... 147762/76
Feb. 17, 1977 [DE] Fed. Rep. of Germany ..... 2706797
Feb. 17, 1977 [DE] Fed. Rep. of Germany ..... 2706798

[51] Int. Cl.[2] ..... A62B 7/00; E04C 2/00
[52] U.S. Cl. ..... 128/145 R; 128/142.4; 52/232; 52/168; 220/88 R; 220/900; 220/453; 220/426; 109/49.5; 109/80
[58] Field of Search ..... 128/145 R, 146.3, 142.4, 128/204; 52/232, 168, 1 R; 2/7, 2.1 A, 8, 2.5; 220/88 R, 900, 453, 426; 109/80, 82, 83, 84, 49.5

[56] References Cited

U.S. PATENT DOCUMENTS 2,595,905 5/1952 Telkes ..... 52/232 X
2,625,930 1/1953 Harris ..... 52/232 X
3,032,772 5/1962 Fonash ..... 2/2.1 A
3,466,222 9/1969 Curtis ..... 52/232 X
3,855,741 12/1974 Semon ..... 52/232 X
4,075,798 2/1978 Tazaki ..... 52/168

*Primary Examiner*—Henry J. Recla
*Attorney, Agent, or Firm*—Pennie & Edmonds

[57] ABSTRACT

In the walls of a fire resistant enclosure such as a cabinet for storing heat sensitive, valuable goods or a room or shelter in a building in which persons can find refuge in the event of a fire, hollow bodies of large area contain substances which melt at a temperature which is still acceptable to the contents of the cabinet or physiologically acceptable to the persons in the room or shelter. The invention also provides various appliances for alleviating conditions in a said room or shelter, for providing a breathing air supply at an acceptable temperature for persons trapped therein and for facilitating the evacuation of persons therefrom, all such appliances involving the use of substances adapted to absorb heat from their environment by utilizing the latent heat of fusion of the substances.

13 Claims, 6 Drawing Figures

FIRE RESISTANT ENCLOSURE

The invention relates to fire resistant enclosures such as cabinets or rooms. It moreover relates to emergency exits for evacuating buildings, particularly for high rise buildings, which are on fire.

It has been proposed to construct cabinets or rooms in which heat sensitive, valuable goods (e.g. data media used in electronic data processing) are to be kept, with walls in which, in the direction from the outside to the inside, a heat insulating layer is followed by a layer of meltable crystalline substances. These walls have the advantage that the expenditure required to maintain an adequately low internal temperature whilst the exterior is exposed to a fire for a predetermined period is relatively low, compared with walls consisting merely of heat insulating layers and heatable masses, e.g. steel plates.

The present invention relates to cabinets and particularly to rooms, in which personnel are intended to find refuge in the event of a fire, i.e. which serve as shelters, particularly for those storeys of high rise buildings, which are inaccessible to firemen's ladders.

According to the invention hollow bodies of large area are provided in the walls of the shelter, in which substances are disposed which melt at a predetermined temperature and thus undergo a phase change from a crystalline phase to a liquid phase where the predetermined temperature is below the maximum physiological temperature at which a human being may stand for a long period of time without suffering ill health. Such substances meltable at this temperature, e.g. 32° C., include for example, Glauber salt. It has been found to be particularly advantageous to arrange in the wall a plurality of hollow bodies, filled with meltable substances, between which a heat insulating layer is disposed. The further outwards the hollow body concerned is located, the higher should be the crystallization temperature of the substances. Even water is suitable as a filling for these further outwardly disposed hollow bodies, since it absorbs a large quantity of heat in the course of its evaporation. Finally, it is also possible to use hydrates of salts having a large water of crystallization content, since these substances first melt and absorb heat already in the process of melting. Thereafter the water of crystallization evaporates and absorbs further heat. By using a plurality of substances having phase transition temperatures which decrease towards the interior of the shelter, the overall amount of material required is considerably reduced. Only meltable substances can be considered for the layer facing the shelter. These melt when heat is applied to them. However they discharge the entire heat absorbed by them as soon as the heat supply ceases. This energy which is released in the form of heat of crystallization therefore continues to stress the interior of the shelter when exposure to fire has ceased but the interior of the shelter is not yet accessible. In order to eliminate this disadvantage, the invention proposes the use of such substances which experience supercooling as the melt cools, i.e. which do not immediately release the heat of fusion which they have absorbed. Such substances include, for example, acetates of light metals. Since supercooling substances do not exist in all temperature regions, the invention teaches two alternatives and solutions for the problem of limiting the temperature in cabinets and shelters.

However, in the case of shelters further inventive steps are required in order to ensure the survival of refugees.

Thus a system for supplying air for breathing is provided which communicates with the ambient air via a thermally insulated pipe. Thereby any shortage of air even in the midst of the conflagration is avoided. Whereas in the case of inanimate goods it is merely necessary for the transition temperature of the latent heat storage layer to be below the temperature which is acceptable for the contents of the shelter, in the case of shelters for personnel an arrangement is, in accordance with the invention, to be provided which contains a latent heat store, whose mass absorbs the heat of oxidation generated by the persons enclosed in the shelter at a rate of approximately 100 W per person.

Since in the event of a fire it is necessary to be prepared for failure of the entire energy supply, the invention provides, besides a ventilation installation supplied from the outside, a breathing air supply system, in which the introduction of air is assumed by the enclosed persons themselves. For this purpose a plurality of air conduits of only small cross-section are provided, which communicate with the ambient air at various locations of the building and which may have closure devices (not shown) in order that only those conduits may be used for introducing air from the outside, through which fresh air can still be admitted. Between these pipes and the interior of the shelter, the invention provides for hollow storage bodies, which are also filled with a meltable storage substance, substances having a melting point of approximately 32° C., but no greater than 80° C., being again selected for the purpose. The surface of the hollow bodies is made of such a size that the air for breathing is cooled to a sufficiently low temperature, even if it has been heated to a high temperature in the pipes. Those conduits with breathing masks and non-return valves provided in the shelters, communicate with these pipes. The trapped persons are thus able themselves to provide themselves with air for breathing. The exhaled air is forced to the outside by reason of the super-atmospheric pressure created in the shelter via discharge apertures in the shelter, which are equipped with outwardly directed non-return valves.

It has however been found that such a shelter still does not satisfy the physiological requirements in the case of long periods of enclosure. The invention therefore provides for an additional heat sink for accepting the physiological heat of combustion of trapped persons, in that in the interior of the shelter further meltable heat stores are provided which are filled with a meltable mass, which melts below 25° C. The magnitude of the mass of this substance is so chosen that the heat defined by the product of mass and fusion enthalpy corresponds to the physiological heat of combustion of the persons seeking refuge. A suitable storage mass is, for example, $CH_3SOCH_3$. In order to intensify the heat exchange between these hollow bodies and the interior air, a ventilation installation is provided which is preferably in the form of a central, manually drivable fan wheel. The hollow bodies may be provided with ribs, in order to form a large surface.

A second embodiment provides that the floor of the shelter is in the form of a grid for standing on, and that a water basin is provided therebelow, in which, e.g. spherical, hollow bodies filled with storage masses are disposed. Water, propelled by manually driven pumps, is atomized on to the trapped persons via atomizing nozzles, the water which again collects below the grid discharging the body heat to the meltable mass, before it is again atomized.

A third embodiment for a heat sink having a meltable substance consists in that hollow bodies with flexible surfaces are created, which are applied directly to the skins of the bodies of the trapped persons, the hollow bodies being filled with a meltable substance whose melting point is below 35° C. These heat sinks may be provided in the form of cushions for stools, but also in the form of helmets or vests.

Finally the invention provides arrangements enabling evacuation from the shelters embodying the invention.

The invention will now be described with reference to the accompanying drawings in which:

FIG. 1 shows, as a function of time, the temperature in the case of two walls of shelters exposed to a fire and having the same heat insulation. Curve 1 relates to an enclosure having a conventional inside wall of steel, and curve 2 to an enclosure with meltable substances in accordance with the invention.

Figure 4:
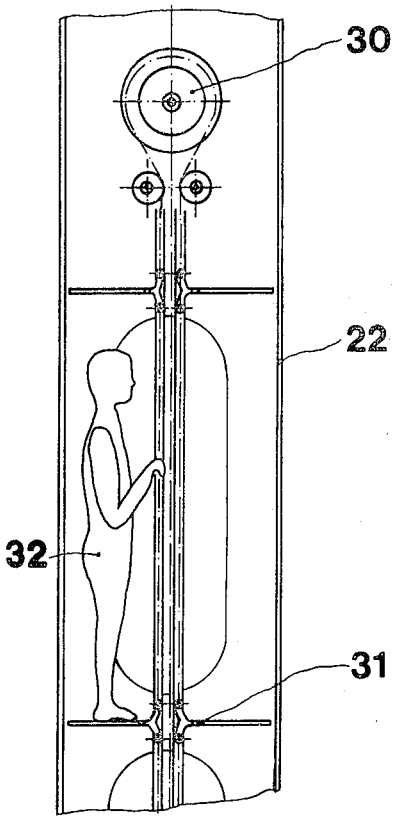
FIG. 4 shows a gravity operated elevator for descending only.

Curve 1 shows how the temperature of the first wall rises and intersects the critical temperature line d, which lies between 35° C. and 50° C., after only approximately 2 hours.

Curve 2 shows, as a function of time, the temperature of the second wall. The meltable substance has a melting point of the level of the line b. The latter is only slightly below the maximum permissible interior temperature d. Over a predetermined period, e.g. 10 hours, the temperature inside the shelter remains constant, and only thereafter does it rise in accordance with the characteristic c, if heat continues to be applied.

The construction of the wall of the fire resistant enclosure is shown in FIG. *2a.* The wall of the shelter is made up of the following layers (stated in the direction from the outside to the inside):

(a) Reflective layer for infra-red radiation
(b) Outer heat insulating layer
(c) Meltable substance with two-phase transition in hollow bodies of large area, i.e. the substance melts, and thereafter, upon the temperature of evaporation being reached, the water of crystallization evaporates
(d) Inner heat insulating layer
(e) Crystalline substance whose melt becomes supercooled. This substance absorbs heat as it melts, but no longer crystallizes, unless feed crystals are artificially added.

The wall embodying the invention has a thickness of only 12 to 20 cm. It is resistant to total exposure to flames extending over several hours. The outer surface is provided with an infra-red-reflecting coating. Chromium plating has been found to be particularly suitable; even more advantageous is galvanization, in which the outwardly directed surface carries an extremely thin deposit of gold.

In accordance with the invention, a coating is painted on the outside wall and consists of a film, which melts upon being heated and burns without leaving any residue, so that the reflective effect of the metallic layer disposed therebelow becomes effective.

Referring to FIG. *2b,* persons seeking refuge reach the interior of the shelter via the hermetically sealing door 2. The floor 3 is in the form of a grid. In the lower region 5, which is filled with water, spheres 6 are disposed which are filled with a meltable substance having a temperature of crystallization of approximately 18° C. In the center a hand pump 7 is provided which, upon failure of the air supply, the possibility of which in case of fire must be reckoned with, is operated by the refugees manually via the grips 8 and which supplies distribution nozzles 9, through which water from the chamber 5 is atomized as shown at 10. A conduit system 11 for air for breathing communicates with the pipes 12 and 13. Prior to its admission to the interior of the shelter, the air which is sucked in passes through the meltable heat stores 14, which may for example be filled with wax, so that the exterior air which is sucked therethrough cannot reach a temperature in excess of, for example, 60° C. and then reaches the interior of the shelter via the chamber 15. The conduits 12 and 13 lead to apertures in the wall, which are provided on opposite sides of the building, so that at least one opening points in the direction of the wind, whatever that direction may be. Through breathing masks 16, which are provided with non-return valves, the refugees themselves suck in the required air for breathing. Through a non-return valve 17 the expended breathing air is discharged to the outside. Through the breathing air supply system 11–16 only a very small quantity of breathing air is sucked in, so that the conduits 12 and 13 can be in the form of thick-walled, small diameter pipes. The current of physiological lost heat generated by the trapped persons is supplied via a spray of water 10 to the water 5, where the spheres 6 with a meltable substance absorb this heat without any rise in temperature.

Figure 3:
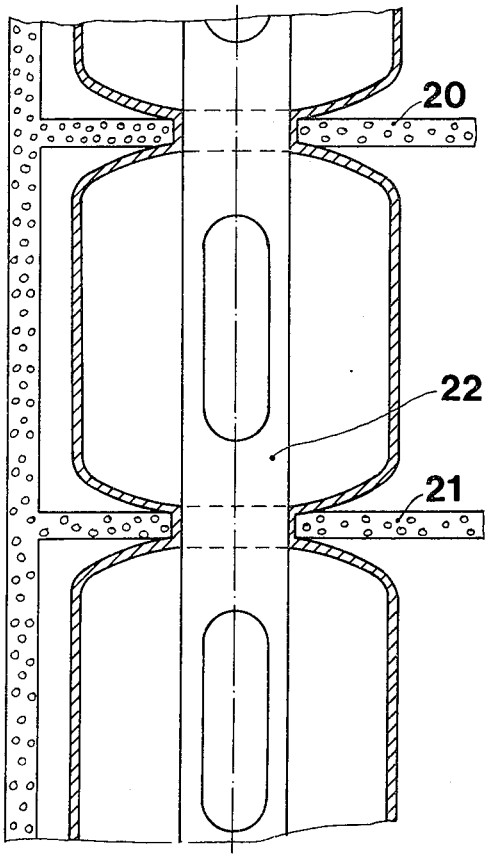
FIG. 3 shows the juxtaposition of a plurality of shelters arranged on successive storeys.
Figure 1:
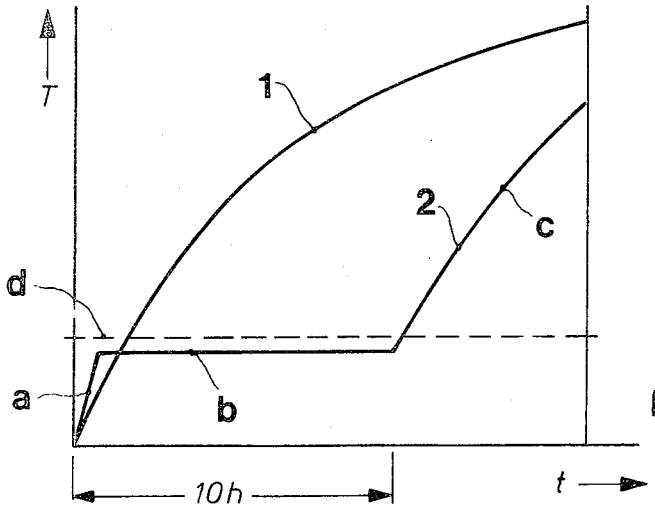
FIG. 1 shows, as a function of time, the temperature inside a cabinet or shelter in the event of a fire.

To the extent to which the structural conditions make this possible, the shelters may - as shown in FIG. 3 - be erected in the various storeys 20, 21 and interconnected via a common escape duct 22.

FIG. 4 shows such an escape duct 22 in which an elevator is disposed which, without any motor drive, enables vertical transportation solely by means of the weight of the persons 32 who are to be transported. The potential energy which is released is absorbed by a brake device 30.

Figure 5:
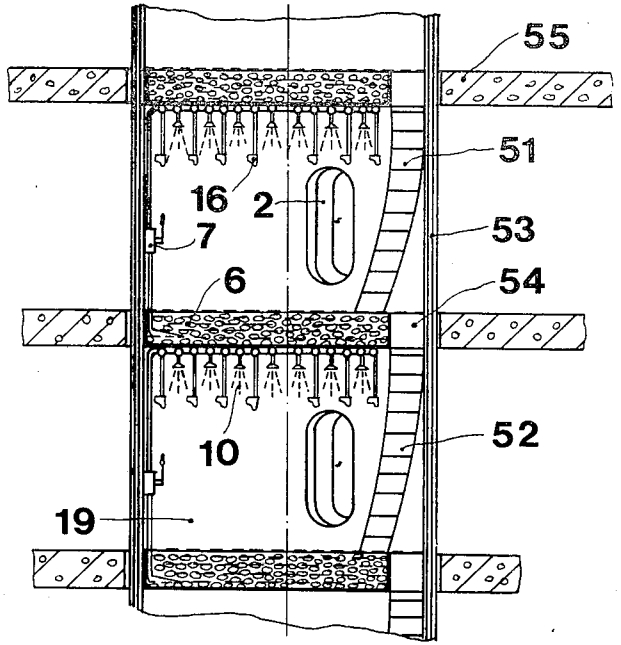
FIG. 5 shows, in horizontal and vertical section, a cylinder which may be arranged outside a building as well as, preferably, inside a lift shaft.
Figure 2A:
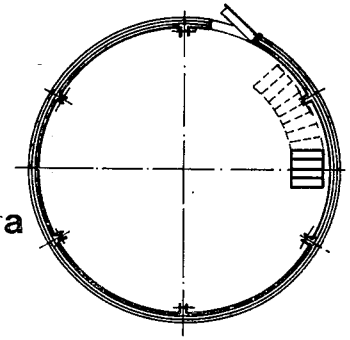
FIG. 2 shows a shelter embodying the invention.
Figure 2A:
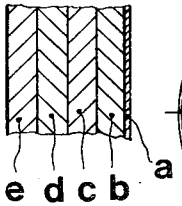
Figure 2B:
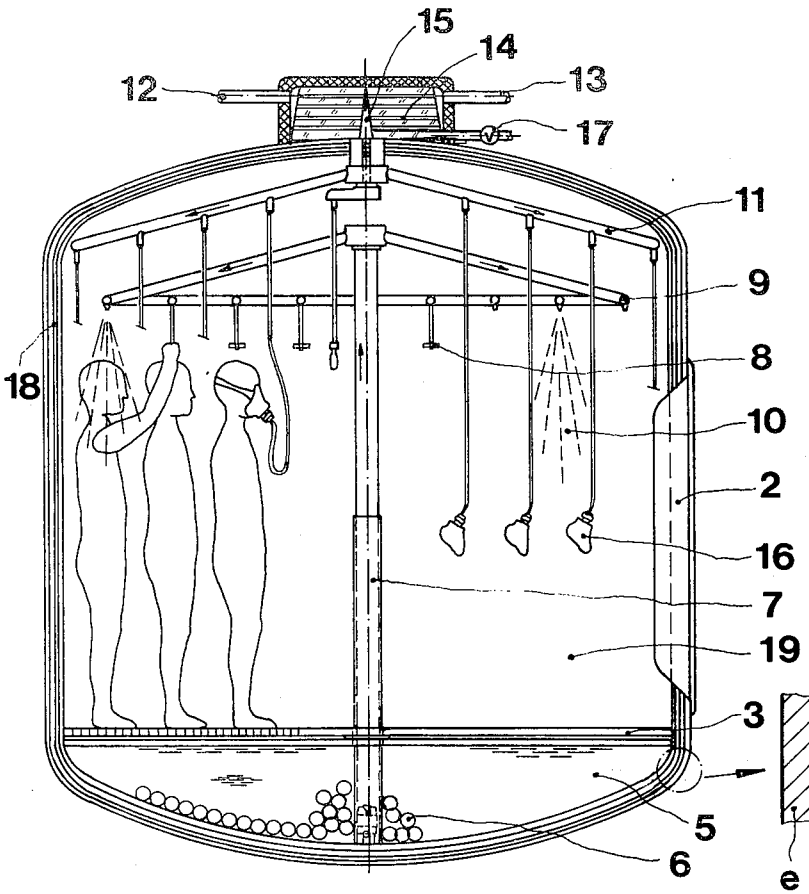

FIG. 5 shows a cylindrical shelter which extends over a plurality of storeys 55 and which is sub-divided into a corresponding number of regions which are interconnected by sealable apertures 54 and which are arranged one above the other; steps 51, 52 may interconnect these regions. In other respects the interiorly arranged elements correspond to the elements shown in FIG. *2b.* The cylinder 53 which forms the wall and which has a layer arrangement corresponding to FIG. *2a,* for example extends over the entire height of a lift shaft, although it may also be arranged adjacent the building in the form of a tower and communicate with the storeys via the doors 2.

We claim:

1. A container defining a shelter for persons having a wall which is heat insulating and protective against fire to prevent the interior of the container from exceeding a predetermined maximum temperature, said predetermined maximum temperature being equal to the physiologically acceptable temperatures of persons within the container, wherein the outer portion of the wall comprises at least one heat insulating layer and at least one other layer adjacent and inwardly of said heat insulating layer, said at least one other layer having hollow bodies of large area which are filled with a meltable crystalline substance whose melting point is below said predetermined maximum temperature and whose temperature of crystallization lies considerably below said melting point.

2. A container according to claim 1 defining a shelter for persons, wherein, for the purpose of providing emergency air for breathing to the persons, there are provided pipes and a chamber, said pipes opening into said chamber and said chamber communicating with the interior of said container, said chamber containing hollow bodies filled with a meltable substance, the melting point of said meltable substance being below 50° C.

3. A container according to claim 2, wherein said meltable substance is wax.

4. A container according to claim 1 defining a shelter for persons, wherein said hollow bodies are in good heat conductive communication with the interior of said shelter.

5. A container according to claim 4, wherein said crystalline substance is $CH_3SOCH_3$.

6. A container according to claim 4 having in addition a chamber filled with water within said container, hollow bodies in said chamber containing a meltable crystalline mass, a pump, a plurality of discharge orifices and conduit means connecting said pump to said orifices with said orifices being positioned where water from said chamber can be distributed over persons in said container by means of said pump to cool the persons in said container.

7. A container according to claim 1 defining a shelter for persons wherein the outer facing surface of said wall has in addition an infra-red radiation reflecting material coated thereon.

8. A container according to claim 7, wherein said outwardly directed surface comprises chromium.

9. A container according to claim 1 defining a shelter for persons, wherein at least one breathing mask provided with a non-return valve is arranged in said container, means being provided for enabling the air for breathing to be sucked into the container by a person dwelling in said container.

10. A container according to claim 1 situated within a multi-storied building and wherein said container defines a shelter for persons, said container extending over a plurality of stories of said building and having apertures and steps therein via which persons can be evacuated from said container.

11. A container according to claim 1 contained within a multi-storied building and wherein said container defines a shelter for persons, said container extending over a plurality of stories of said building and having in addition a conveyor device therein which is driven by the weight of persons proceeding by means of said device in a downward direction.

12. A container according to claim 11 wherein said wall comprises a tube adapted to be disposed in a lift shaft contained within the building.

13. A container defining a shelter for persons having a wall which is heat insulating and protective against fire to prevent the interior of the container from exceeding a predetermined maximum temperature, said predetermined maximum temperature being equal to the physiologically acceptable temperature of persons within the container, wherein said wall comprises an outer heat insulating layer and at least one inner heat insulating layer, and at least two further layers adjacent and inwardly of said outer heat insulating layer and separated from each other by said inner heat insulating layer, said further layers having hollow bodies of large area which are filled with substances which absorb heat and undergo a phase change whereby, said phase change of the further layer which faces the interior of the container is a phase change from a crystalline phase to a liquid phase at a predetermined temperature below said predetermined maximum temperature, the predetermined temperature of the substance of said further layer which faces the interior of said container being lower than the predetermined temperature of the substance of said further layer disposed further outwardly.

* * * * *